US005454924A

United States Patent [19]

Jansen et al.

[11] Patent Number: 5,454,924

[45] **Date of Patent: * Oct. 3, 1995**

[54] APPARATUS FOR THE ELECTROLYTIC RECOVERY OF SILVER FROM SOLUTIONS CONTAINING SILVER

[75] Inventors: Benedictus J. Jansen, Geel; Werner J. Van de Wynckel, Mortsel; Frank P. Michiels, Arendonk, all of Belgium

[73] Assignee: AGFA-Gevaert N.V., Mortsel, Belgium

[ * ] Notice: The portion of the term of this patent subsequent to Jan. 3, 2011 has been disclaimed.

[21] Appl. No.: 303,684

[22] Filed: Sep. 9, 1994

[51] Int. Cl.[6] ..... C25C 1/20

[52] U.S. Cl. ..... 204/272; 204/231

[58] Field of Search ..... 204/434, 435, 204/109, 290 R, 231, 272

[56] References Cited

U.S. PATENT DOCUMENTS 4,406,753 9/1983 Blake ..... 204/109

5,203,979 4/1993 Üffinger et al. ..... 204/272

5,370,781 12/1994 Van de Wynckel ..... 204/280

5,378,340 1/1995 Van de Wynckel ..... 204/272

*Primary Examiner*—John Niebling

*Assistant Examiner*—Brendan Mee

*Attorney, Agent, or Firm*—Brumbaugh, Graves, Donohue & Raymond

[57] ABSTRACT

An apparatus for the electrolytic recovery of silver from solutions containing silver is described. The apparatus comprises an electrolytic cell, an anode positioned within the cell, a reference electrode positioned within the cell, and a removable cathode positioned within the cell. The cathode has an inner face directed towards the anode and an outer face directed towards the reference electrode. The apparatus includes means for restraining the deposition of silver on the outer face of the cathode. The risk of incorrect potentials being sensed by the reference electrode are thereby reduced or avoided. The tendency for side reactions to occur is also reduced.

13 Claims, 5 Drawing Sheets

APPARATUS FOR THE ELECTROLYTIC RECOVERY OF SILVER FROM SOLUTIONS CONTAINING SILVER

DESCRIPTION

1. Field of the Invention

This invention concerns an apparatus for the electrolytic recovery of silver from solutions containing silver, in particular used photographic solutions such as fixing and bleach-fixing solutions.

2. Background of the Invention

Electrolytic silver recovery from used photographic solutions is a common way to extend the life of such solutions.

The control of the electrochemical process taking place at the anode and the cathode is important in the silver recovery process. In some arrangements, a constant anode/cathode potential is applied. When the desilvering of the solution reaches its end, a decrease in the electrolytic current occurs and the process is usually shut off when the current falls below a predetermined level. The disadvantage of this approach is that the deposition potential is not controlled exactly in many practical situations and that the actual potential difference between the cathode and the solution (the "cathode potential") is unknown and varies during desilvering, causing unnecessary side reactions or a non-optimum desilvering rate.

The above arrangement suffers from the disadvantage that the actual plating potential is often not known when used in practical applications where the actual fixing solution to be desilvered contains not only fixer but also developer components carried over from the developing tank, replenishment solution, additives, reaction products of development or of previous desilvering etc.

If the desilvered fixing solution is to be reused, it is desirable to minimize side reactions taking place at the anode and cathode which would give rise to unwanted by-products.

The positioning of a reference electrode is important to the desilvering process. Due to the ohmic potential drops, which may be higher than 100 mV for electrolytic cells with high current densities, the potential of the reference electrode is dependant upon its position. In principle the electrode would be best placed between the cathode and the anode, as close as possible to the cathode. This may however cause troubles as more and more silver is deposited on the cathode, which is thus growing thicker. When the reference electrode is placed further from the cathode ohmic potential drops will cause the potentiostatic desilvering not to be truly potentiostatic. It has therefore been proposed to place the reference electrode on the far side of the cathode from the anode, but close to the cathode. An apparatus for the electrolytic recovery of silver from solutions containing silver is known from European patent application EPA 93200427.8 (Agfa-Geveart NV) filed 16 Feb. 1993. The apparatus comprises an electrolytic cell and an anode, a removable cathode and a reference electrode all positioned within the cell. The cathode has an inner face directed towards the anode and an outer face directed towards the reference electrode. In use silver from the silver containing solution is deposited on the face of the cathode which is directed towards the anode.

The use of a reference electrode allows a much better control of the silver deposition process, since the potential difference between the cathode and the fixer solution can be controlled. In this arrangement the potential difference between the cathode and the anode can be controlled by a feed back mechanism which keeps the potential difference between the cathode and the reference electrode constant (potentiostatic control). This allows optimum control of the plating reaction, since the reactions taking place at the electrodes are essentially controlled by the potential difference between the electrode and the solution.

For optimum performance of the cell, it is important that the potential between the cathode and the reference electrode is accurately controlled. For example, where an Ag/AgCl reference electrode is used, the potential between the cathode and the reference electrode is about 400 mV. When the unit is to perform optimally, meaning employing the maximum current without causing side reactions to occur, the potential should be measured with an accuracy of some millivolts. We have found that while the bulk of the deposited silver is formed on that face of the cathode which is directed towards the anode, some silver is liable to become deposited on the face of the cathode directed towards the reference electrode and this deposited silver can interfere with the measurement of potential between the cathode and the reference electrode. In one embodiment of such a cell, the cathode includes an opening extending from the outer face to the inner face, the opening being located in the neighbourhood of said reference electrode to ensure that the reference electrode is located within the electrical field of the cell. We have found that silver may become deposited on the outer face of the cathode in the vicinity of the opening, disturbing the field in which the reference electrode is positioned.

It is an objective of the present invention to reduce or avoid these disadvantages of such electrolytic silver recovery cells.

SUMMARY OF THE INVENTION

According to the invention, there is provided an apparatus for the electrolytic recovery of silver from solutions containing silver, the apparatus comprising:

an electrolytic cell;

an anode positioned within the cell;

a reference electrode positioned within the cell;

a removable cathode positioned within the cell, the cathode having an inner face directed towards the anode and an outer face directed towards the reference electrode; and means for restraining the deposition of silver on the outer face of the cathode.

We have found that an apparatus constructed according to the invention is capable of reducing or avoiding the risk of incorrect potentials being sensed by the reference electrode. Furthermore, we have found that in some embodiments of the invention, the tendency for side reactions and cathode poisoning to occur is reduced.

In a first embodiment of the invention, the means for restraining the deposition of silver on the outer face of the cathode may comprise an electrically non-conductive surface provided on at least a portion of the outer face of the cathode. Preferably, the outer face of the cathode is provided with an electrically non-conductive coating. Suitable coating materials include inorganic and organic materials, especially organic polymeric film-forming materials such as polyethylene and polyacrylate. The coating material should ideally be substantially water-insoluble and inert to any of the components which are likely to be present in the treated solutions. Suitable coating techniques include silk screen printing, spraying, brush painting and laminating.

In alternative embodiments of the invention, the means for restraining the deposition of silver on the outer face of the cathode may comprise screening means for screening the outer face of the cathode from the reference electrode.

The electrolytic cell is suitably formed of electrically non-conductive material and may be generally cylindrical, although other shapes are possible. A cylindrical shape to the cell enables the cathode to be positioned near to the wall of the cell. The anode has a generally linear configuration axially located within the housing. The cathode has an open circular cross-sectional configuration surrounding the anode. The reference electrode is located in a side arm of the housing. Preferably, the housing further comprises a liquid inlet and a liquid outlet for the electrolyte liquid, predetermining a liquid level within the cell. The electrically non-conductive surface should be provided on the outer face of the cathode below the liquid level. In an embodiment of the cell an electrically conductive contact surface is provided above the liquid level and clamping means serve to clamp a contact portion of the cathode against the contact surface to complete an electrical connection to the cathode, the contact portion of the cathode should have an electrically conductive surface. The provision of the contact surface in an upper part of the electrolytic cell, in particular an annular contact surface, enables this surface to be above the level of the electrolyte in the cell in use, thus reducing the risk of leakage and corrosion. Thus, we prefer that at least part of the outer face of the cathode above the liquid level has an electrically conductive surface.

The cathode preferably includes an opening extending from the outer face to the inner face, the opening being located in the neighbourhood of the reference electrode. This ensures that the reference electrode is located within the electrical field of the cell, even though it is positioned on the opposite side of the cathode from the anode. In such an embodiment, the means for restraining the deposition of silver on the outer face of the cathode may comprise sealing means positioned between the cathode and the housing adjacent the opening for screening the outer face of the cathode from the reference electrode.

The cathode may be formed from a generally flat sheet of flexible material, an electrically conductive surface being provided on one major face thereof, and an electrically non-conductive surface being provided on at least a portion of the other major face thereof, securing means being provided to enable the sheet to be folded into and secured in an open circular cross-sectional configuration. The cathode preferably ideally has a frusto-conical cross-section, with its larger radius end uppermost, that is towards the circular upper opening of the electrolyte cell. This configuration enables easy removal of the cathode even after a silver deposit has built up there-on after use. Usable cathode materials include stainless steel, silver, silver alloys and other conductive materials, stainless steel being preferred from the point of view of costs. Preferably, the other major face of the cathode is provided with an electrically non-conductive coating. In this embodiment, the electrically non-conductive coating is preferably visually distinct, to ensure that the cathode is formed with the electrically non-conductive face on the outside.

The material used for the anode is less critical, although platinated titanium is usually used. Platinum, graphite and nobel metals are alternatives. The anode may be in the form of a rod, located at the axis of the electrolytic cell, where this is in cylindrical form.

The reference electrode may conveniently be positioned adjacent the outlet port of the cell. Reference electrodes suitable for use in electrolytic desilvering include calomel type electrodes or Ag/AgCl type electrodes, but we particularly prefer the use of a pH sensitive electrode such as a glass electrode, a hydrogen electrode, a quinhydrone electrode and an antimony electrode, most especially a glass electrode which is relatively maintenance free and which is moreover insensitive to hydrostatic pressure variations. The potential at which the reduction of sulphite starts to take place is dependant on the pH of the fixing solution, therefore, the potential to be used for optimum desilvering is dependant upon the nature of the fixer used and other parameters such as the pH of the developer bath, the presence or absence of intermediate rinsing, the degree of carry over from the developer to the fixer, and the buffering capacities of the developer and the fixer solutions. In practical terms this means there is no common potential for optimum desilvering for various fixers having different pH values. For optimum desilvering, every fixer solution with a different pH would require a different potential difference between the reference electrode and the cathode. It is for these reasons that a pH electrode is preferred as the reference electrode. A suitable electrode has been disclosed in European patent application EPA 92203439.2 filed 11 Nov. 1992 and entitled "pH Sensitive Reference Electrode in Electrolytic Desilvering".

The "solutions containing silver" which can be desilvered using the apparatus according to the present invention include any solution containing silver complexing agents, e.g. thiosulphate or thiocyanate, sulphite ions as an anti-oxidant and free and complexed silver as a result of the fixing process. The apparatus can also be used with concentrated or diluted used fixing solutions, or solutions containing carried-over developer or rinsing water. Apart from the essential ingredients, such solutions will often also contain wetting agents, buffering agents, sequestering agents and pH adjusting agents.

The apparatus of the present invention can also be used for desilvering bleach-fixing solutions which may additionally contain bleaching agents such as complexes of iron(III) and polyaminocarboxylic acids.

The desilvering process can be carried out batch-wise or continuously, the apparatus being connected to the fixing solution forming part of a continuous processing sequence.

It will be understood that the apparatus of the present invention can also be used in applications where accurate potential control is unnecessary, e.g. in desilvering a fixer which is to be discarded.

PREFERRED EMBODIMENTS OF THE INVENTION

The invention will now be further described, purely by way of example, by reference to the accompanying drawings in which.

2; in the folded, ready for use, condition; and

Figure 4:
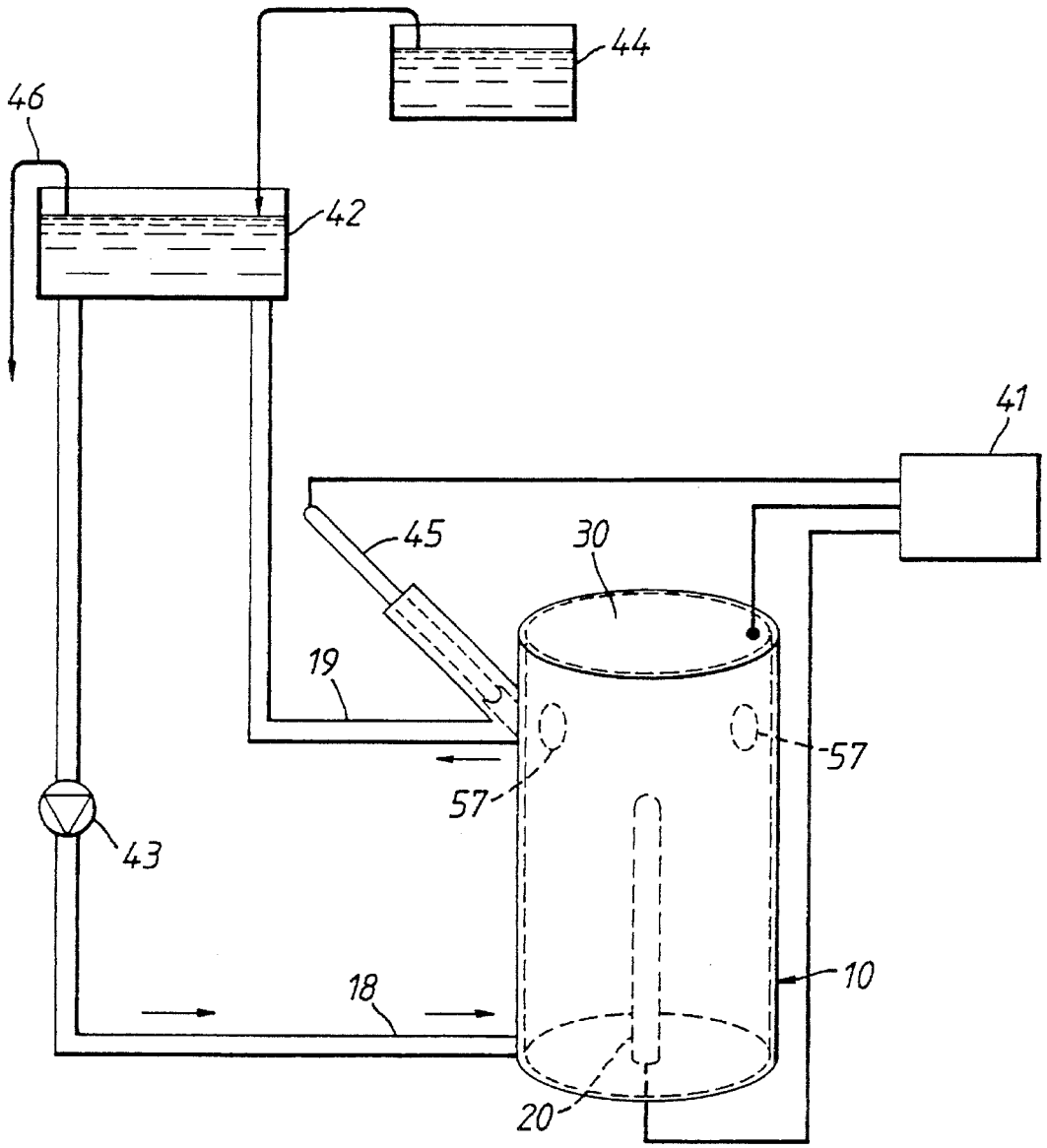

FIG. 4 is a schematic representation of the use of an apparatus according to the present invention.

Figure 1A:
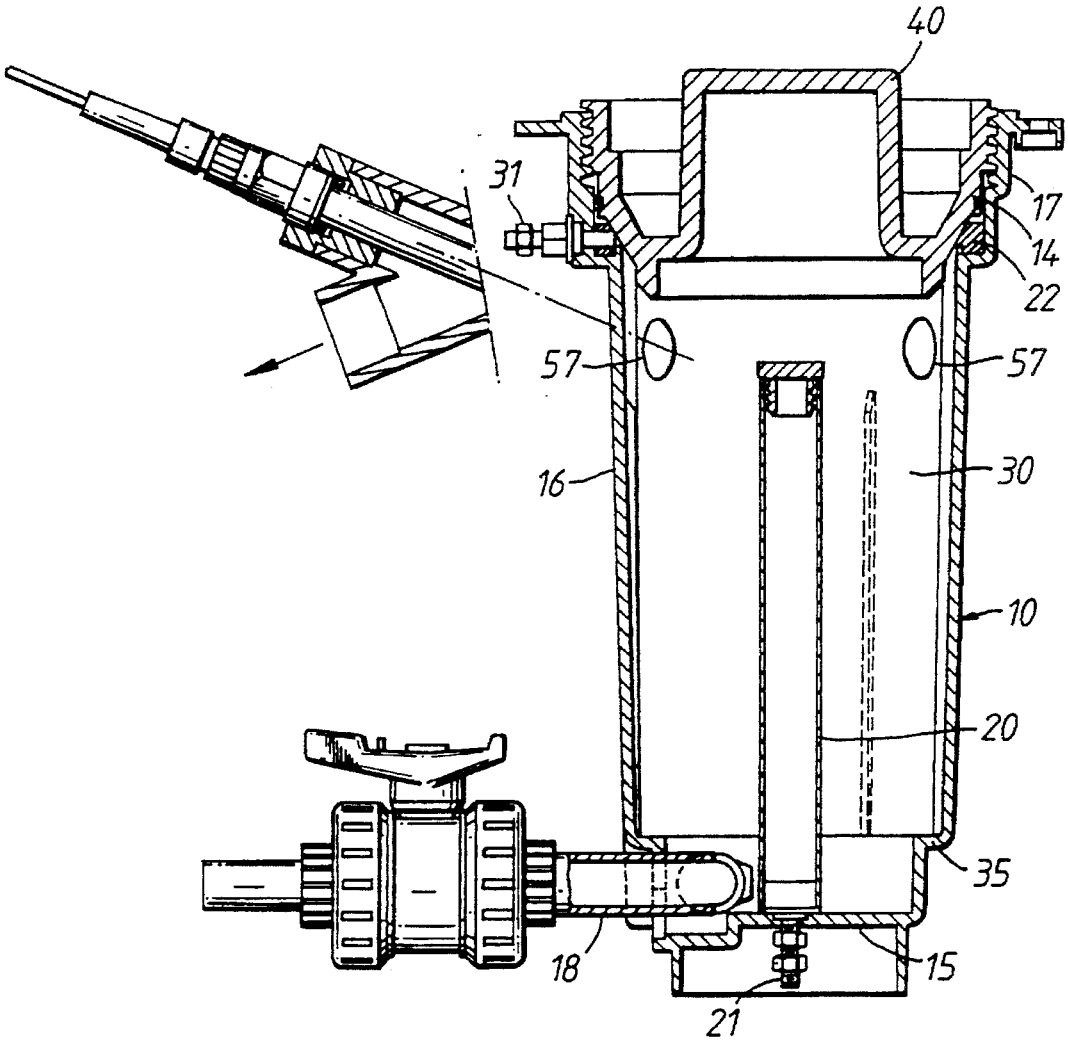
FIG. 1A shows, partly in cross-section, an apparatus incorporating a cathode according to the invention.
Figure 1B:
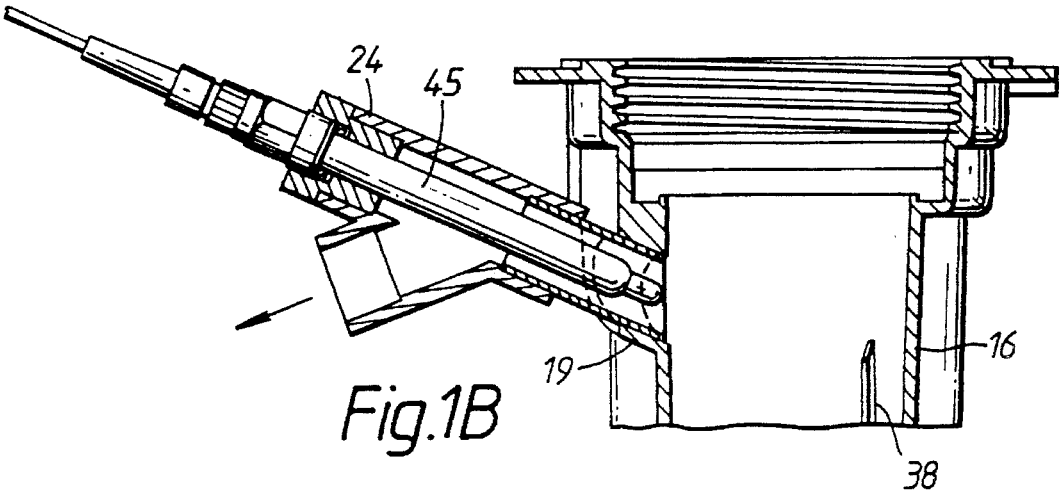
FIG. 1B shows a cross-section of part of the housing of the apparatus shown in FIG. 1A from a different angle, with the cathode and lid of the housing removed.
Figure 1C:
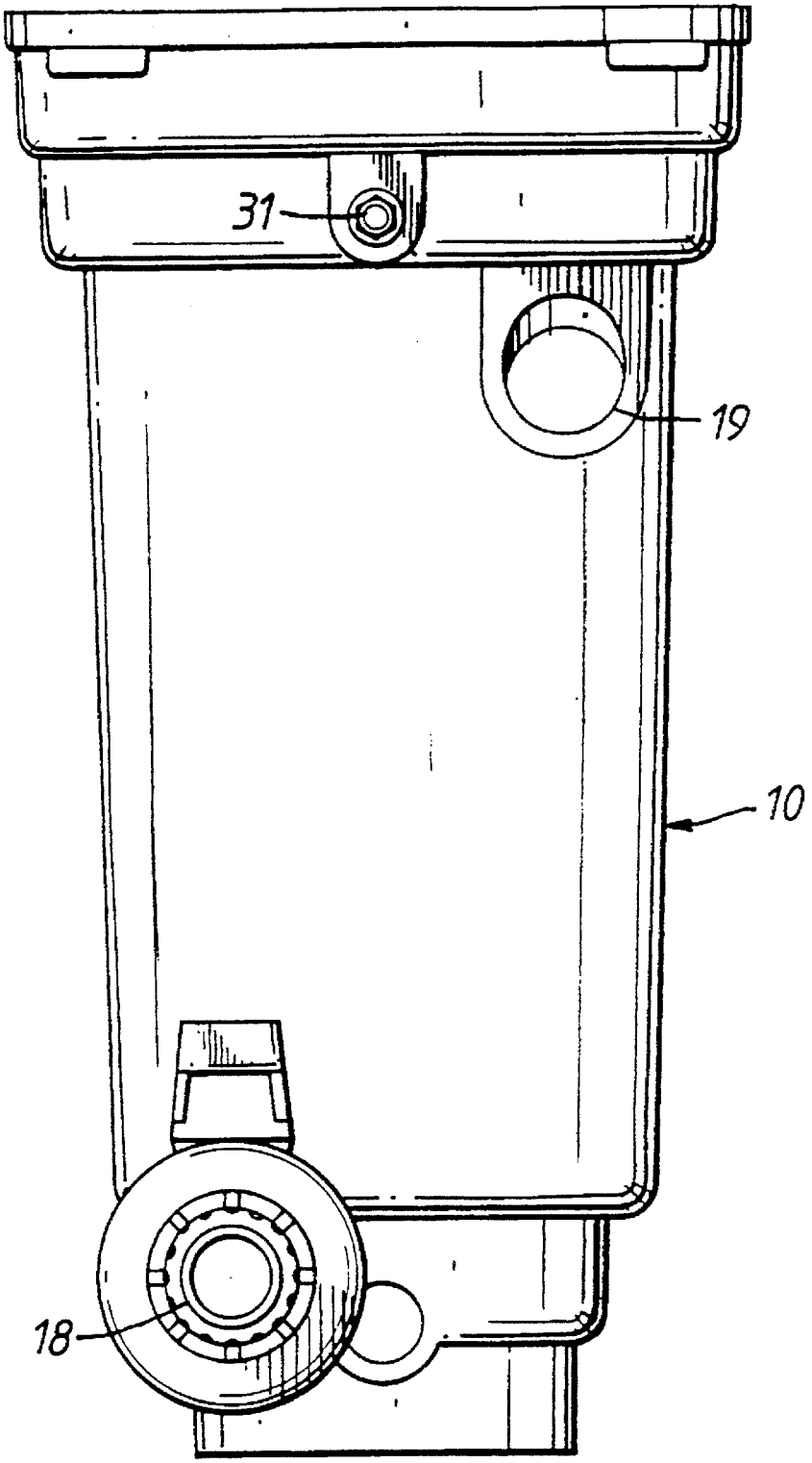
FIG. 1C shows a view of the housing of the apparatus shown in FIG. 1A, from one side thereof.

As shown in FIGS. 1A, B and C, the apparatus comprises an electrolytic cell housing 10, formed of electrically non-conductive material such as PVC, and comprising a base 15, sides 16 and an upper portion 17. An electrolyte inlet port 18 is provided towards the bottom of the cell and an electrolyte outlet port 19 is provided towards the top of the cell, angularly offset from the inlet port 18.

An anode 20, in the form of a platinised titanium rod, is secured to the base 15 of the cell by means of a bolt 21 which acts as an electrical connector for the anode. The anode 20 lies along the axis of the housing 10. A reference electrode 45 is positioned in a side arm 24 of the outlet port 19 and protrudes into the housing 10 of the cell. A suitable reference electrode is a pH sensitive glass electrode such as a YOKOGAWA SM21/AG2 or an INGOLD HA 265-S8/120 glass electrode.

The upper part 17 of the cell is in the form of a neck portion having an opening defined by a stainless steel ring 22. The contact surface of the ring 22 is frusto-conically shaped, having its narrower radius downwards. The stainless steel ring 22 is permanently fixed to one end of a bolt 31 which extends through the wall of the cell and provides a connector for the cathode 30. Positioned in the neck of the cell, below the level of the annular ring 22, is a sealing ring 14.

The apparatus further comprises a lid 40 so shaped as to fit into the neck portion of the cell. The lid 40 is formed of electrically non-conductive material such as PVC. The lower portion of the lid 40 is shaped to correspond to the shape of the ring 22.

Figure 2:
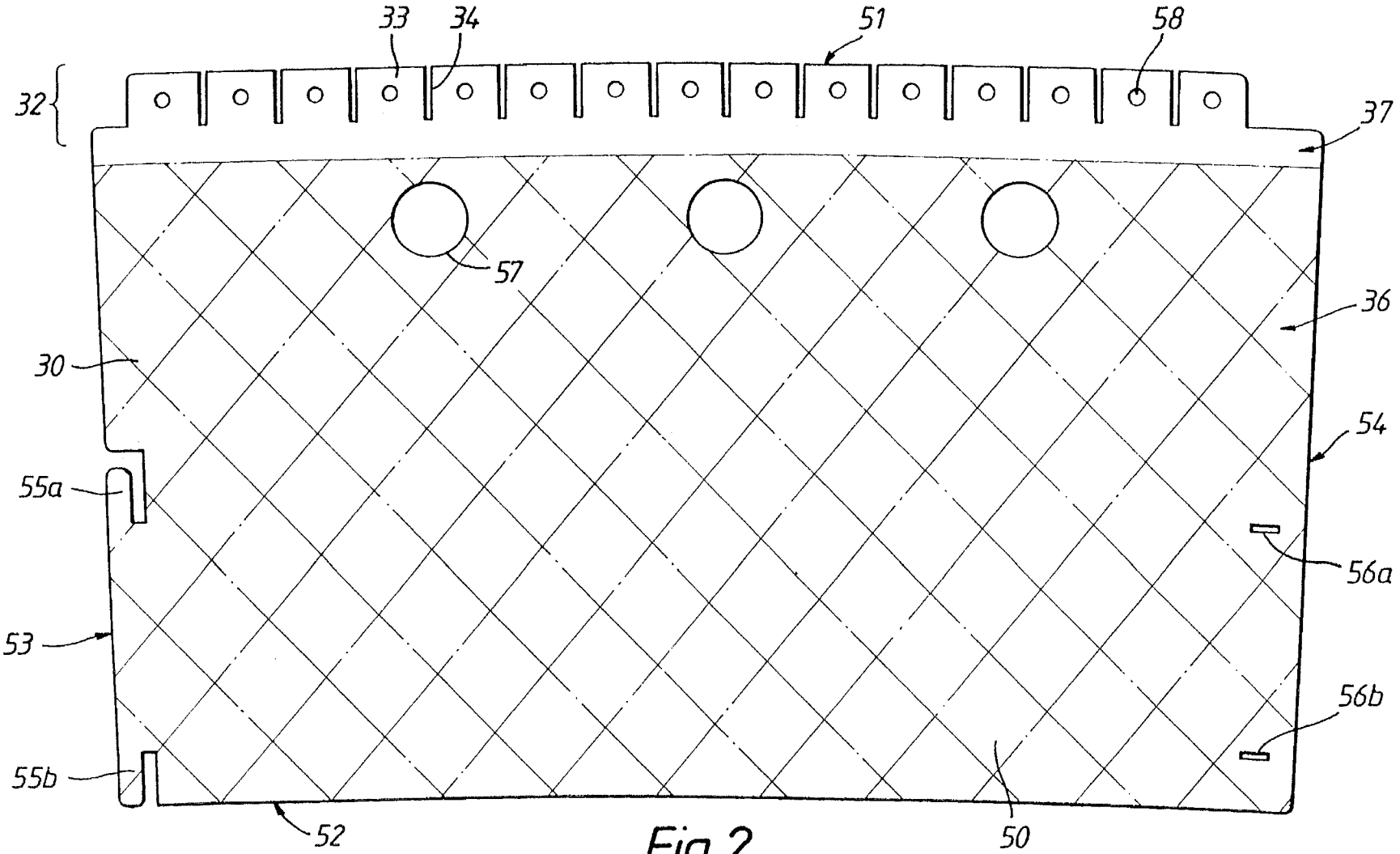
FIG. 2 is a view of a cathode for use in an electrolytic cell according to the invention, in the flat condition.
Figure 3:
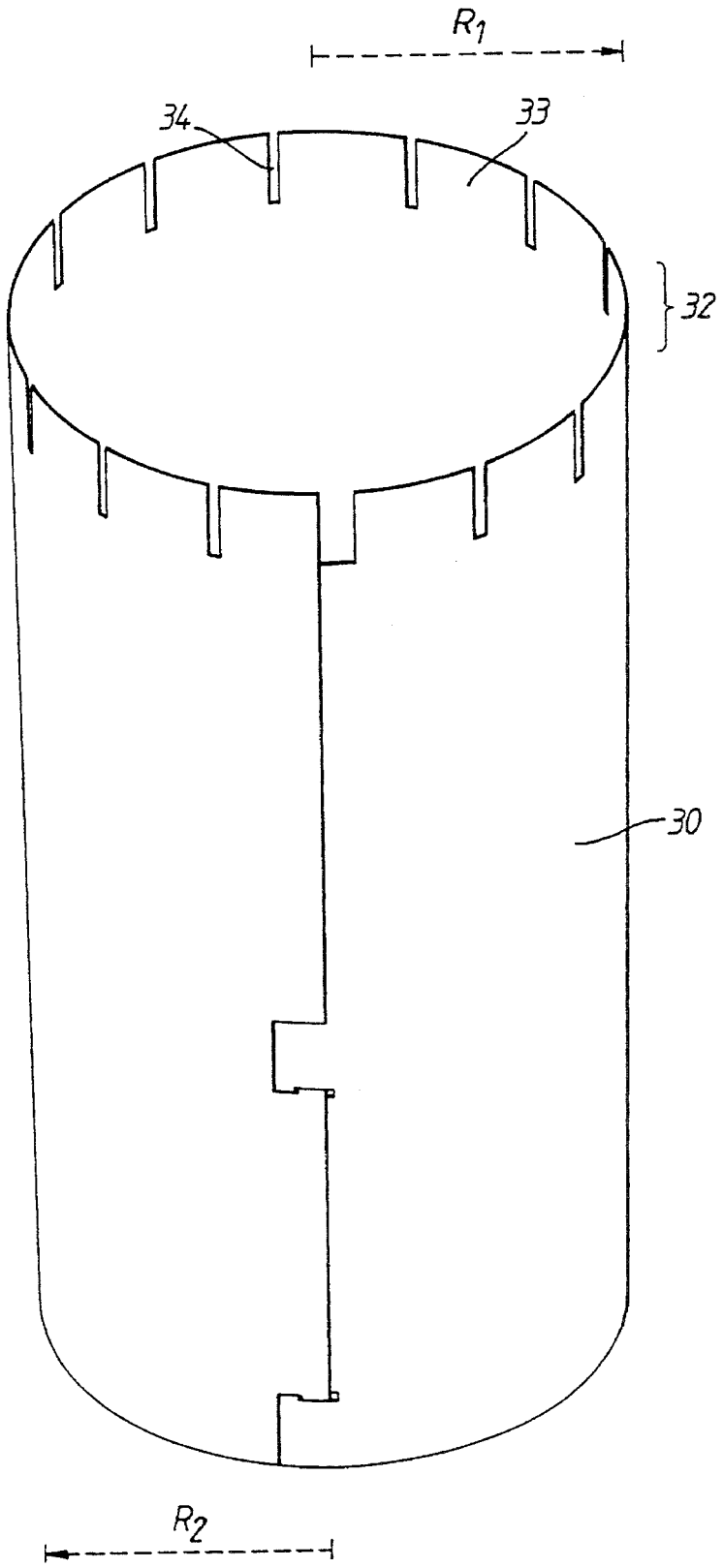
FIG. 3 is a perspective view of the cathode shown in FIG.

Referring in particular to FIGS. 2 and 3, the cathode 30, formed for example of a flat stainless steel sheet 50 having a thickness of 100 μm, is wrapped around into a frusto-conical configuration. The sheet 50 has a slightly curved upper edge 51, a concentrically parallel slightly curved bottom edge 52 and two diverging opposite side edges 53, 54. Upper and lower pairs of securing means are provided each comprising a tongue-shaped cut out portion **55*a*, 55*b* formed along the side edge 53 and a slot 56*a*, 56*b* adjacent the opposite side edge 54. The elements 55*a*, 56*a* of the upper securing means are spaced further from each other than the elements 55*b*, 56*b* of the lower securing means by a factor of about 1.02. The tongue-shaped cut-out portions 55*a*, 55*b* can be fitted into the corresponding slots 56*a*, 56*b* to enable the sheet 50 to be folded into and secured in an open frusto-conical configuration, as shown in FIG. 3, where the upper radius $R_1$ is marginally larger than the lower radius $R_2$ by a factor of 1.05. The cathode 30 has a deformable upper edge portion 32. Castellations 33 are formed at the upper edge of the cathode by the provision of incisions 34 extending longitudinally away from that edge. The castellations or tabs 33 together form a deformable upper edge portion 32** of the cathode, the sheet material of which the cathode is formed being sufficiently resilient to allow the castellations to bend outwardly in response to outwardly directed force.

The rear surface of the cathode 30 (as viewed from FIG. 2) is electrically conductive whereas the front surface is partly coated over a region 36 with an acrylic polymer which is applied by silk screen printing. The coated region 36 does not extend to the top edge of the cathode, there being an uncoated region 37 which includes the castellations 33, this portion remaining uncoated to ensure a good electrical contact between the cathode and the stainless steel ring 22 of the housing 10.

The cathode is provided with a number of openings 57 which extend therethrough. The cathode 30 is located in the cell 10 with its bottom edge supported by a cathode support ledge 35 in the cell and its faces spaced from the sides 16 by virtue of ribs 38 formed on the inside surface of the sides 16. One of the openings 57 is located in the neighbourhood of the reference electrode 45. The deformable upper edge portion 32 of the cathode lies adjacent the stainless steel ring 22. Tightening of the lid causes the castellations 33 to be clamped firmly by the lid against the ring 22, thereby establishing good electrical contact there-between.

In the closed position of the lid, the sealing ring 14 bears against the outer surface of the lid 40, thereby forming a tight seal. Electrolyte liquid is now fed into the cell by way of the inlet port 18, fills the cell and exits by way of the outlet port 19. The effect of the sealing ring 14 is to prevent the electrolyte level rising above the level of the outlet port 19, so maintaining an air space above the liquid and preventing contact between the liquid and the annular contact surface 11. The risk of corrosion of the latter is thereby reduced.

The cell is then operated under usual conditions, during which a silver deposit builds up on the cathode 30, primarily on the inside surface thereof. After a period of time determined by the required amount of deposited silver, the operator unscrews the lid 40 and lifts the cathode 30 out of the cell. To enable this to be done, each of the castellations 33 is provided with a hole 58 (shown only in FIG. 2) into which a retracting tool may be inserted. Due to the frusto-conical cross-section of the cathode, the sides of the cathode will not foul against the ring 22, even when some small amount of silver deposit has built up on the outside surface thereof. The silver deposit is then removed from the cathode, which may then be re-used as desired or replaced by another of similar construction for the de-silvering of a further batch of electrolyte.

Referring to FIG. 4 it will be seen that the anode 20, the cathode 30 and the reference electrode 45 of the electrolytic cell 10 are connected to a potentiostat 41 which controls the application of electrical power to the anode and the cathode. The cell 10 is fed with contaminated fixer from a first fixer container 42 via a pump 43 which is provided with a filter (not shown). In practice it is typical for this contaminated fixer to comprise 9 parts diluted fixing solution to 1 part of diluted developer solution, containing 0.5 g silver per liter. The diluted fixing solution may contain for example 137 g ammonium thiosulphate, 10.8 g sodium sulphite, 5 g boric acid, 14 g sodium acetate 3 aq. and 8 ml acetic acid per liter. The diluted developer solution may contain for example 2.5 g hydroxyethylethylenediamine-triacetic acid, 23.7 g potassium carbonate, 65.3 g potassium sulphite, 1.3 g sodium tetrapolyphosphate, 10 g potassium bromide, 5.3 g potassium hydroxide, 20 ml diethylene glycol, 20 g hydroquinone, 0.48 g phenidone, and 30 mg 1-phenyl-5-mercaptotetrazole per liter.

The contaminated fixing solution is topped up from time to time with fresh fixing solution from a second fixer container 44, while the total liquid volume is maintained at a constant level by means of an overflow 46.

We claim:

1. An apparatus for the electrolytic recovery of silver from solutions containing silver, said apparatus comprising:

an electrolytic cell;

an anode positioned within said cell;

a reference electrode positioned within said cell;

a removable cathode positioned within said cell, said cathode having an inner face directed towards said anode and an outer face directed towards said reference electrode; and means for restraining the deposition of silver on said outer face of said cathode.

2. An apparatus according to claim 1, wherein said means for restraining the deposition of silver on said outer face of said cathode comprises an electrically non-conductive surface provided on at least a portion of said outer face of said cathode.

3. An apparatus according to claim 2, wherein said outer face of said cathode is provided with an electrically non-conductive coating.

4. An apparatus according to claim 1, wherein said cathode includes an opening extending from said outer face to said inner face, said opening being located in the neighbourhood of said reference electrode.

5. An apparatus according to claim 1, wherein said means for restraining the deposition of silver on said outer face of said cathode comprises screening means for screening said outer face of said cathode from said reference electrode.

6. An apparatus according to claim 1, wherein said electrolytic cell comprises a generally cylindrical housing having a side arm, said anode has a generally linear configuration axially located within said housing, said cathode has an open circular cross-sectional configuration surrounding said anode, and said reference electrode is located in said side arm of said housing.

7. An apparatus according to claim 6, wherein said housing further comprises a liquid inlet and a liquid outlet predetermining a liquid level within said cell, said cathode being provided with an electrically non-conductive surface on its outer face below said liquid level.

8. An apparatus according to claim 7, wherein at least part of said outer face of said cathode above said liquid level has an electrically conductive surface.

9. An apparatus according to claim 8, wherein said cell further comprises an electrically conductive contact surface above said liquid level and clamping means to clamp a contact portion of said cathode against said contact surface to complete an electrical connection to the cathode, said contact portion of said cathode having an electrically conductive surface.

10. An apparatus according to claim 1, wherein said cathode includes an opening extending from said outer face to said inner face, said opening being located in the neighbourhood of said reference electrode, said means for restraining the deposition of silver on said outer face of said cathode comprising sealing means positioned between said cathode and said housing adjacent said opening for screening the outer face of said cathode from said reference electrode.

11. An apparatus according to claim 1, wherein said cathode is formed from a generally flat sheet of flexible material, an electrically conductive surface being provided on one major face thereof, and an electrically non-conductive surface being provided on at least a portion of the other major face thereof, securing means being provided to enable the sheet to be folded into and secured in an open circular cross-sectional configuration.

12. An apparatus according to claim 11, wherein said other major face of said cathode is provided with an electrically non-conductive coating.

13. An apparatus according to claim 12, wherein said electrically non-conductive coating is visually distinct.

* * * * *